US005113200A

United States Patent [19]

Deguchi et al.

[11] Patent Number: 5,113,200

[45] Date of Patent: May 12, 1992

[54] HOT MELT INK JET APPARATUS HAVING INTERVENTION MEMBER LOCATED BETWEEN MEMBER AND A PRINTED PRINTING SHEET

[75] Inventors: Masaaki Deguchi, Okazaki; Shigeru Mizuno, Nagoya, both of Japan

[73] Assignee: Brother Kogyo Kabushiki Kaisha, Aichi, Japan

[21] Appl. No.: 497,707

[22] Filed: Mar. 23, 1990

[30] Foreign Application Priority Data

May 16, 1989 [JP] Japan ..... 1-121842

[51] Int. Cl.[5] ..... B41J 2/225

[52] U.S. Cl. ..... 346/25; 346/140 R; 101/420

[58] Field of Search ..... 346/25, 140 R, 1.1; 400/126; 101/487, 488, 420; 355/284, 290, 295

[56] References Cited

U.S. PATENT DOCUMENTS 4,257,699 3/1981 Lentz ..... 355/3 FU
4,501,482 2/1985 Stryjewski ..... 355/3 FU
4,725,853 2/1988 Kobayashi et al. ..... 346/76 PH
4,745,420 5/1988 Gerstenmaier ..... 346/140

FOREIGN PATENT DOCUMENTS 0029228 3/1977 Japan ..... 355/284
62-161542 7/1987 Japan .

*Primary Examiner*—Benjamin R. Fuller
*Assistant Examiner*—Victor DeVito
*Attorney, Agent, or Firm*—Oliff & Berridge

[57] ABSTRACT

A hot melt ink jet apparatus is disclosed which heats a normally solid ink into a molten state and then ejects the molten ink toward a printing sheet. When printing is performed on the printing sheet, the ink ejected onto the printing sheet quickly solidifies. After the printing operation, the printed sheet is fed between a supporting member and a pressing member. An intervention member is provided between the printed sheet and pressing member. The intervention member includes a layer which has a low cohesiveness and is softer than lumps of solidified ink on the printing sheet.

18 Claims, 3 Drawing Sheets

HOT MELT INK JET APPARATUS HAVING INTERVENTION MEMBER LOCATED BETWEEN MEMBER AND A PRINTED PRINTING SHEET

BACKGROUND OF THE INVENTION

1. Field of the Invention

This invention relates to a hot melt type ink jet apparatus, and more particularly to fixation of ink on printing paper.

2. Description of Related Art

Ink jet printers, including the so-called hot melt type, are designed to eject liquid ink against printing paper to record characters and patterns on the paper. Hot melt type ink jet printers are arranged to heat and melt a normally solid ink at the time of printing and to eject the molten ink to print a character. Generally, hot melt type ink jet printers include (a) a platen which serves to support printing paper, (b) an ink supplying device which is adapted to store a normally solid ink therein and is provided with an ink heater for melting the ink, and (c) an ink ejection head which ejects molten ink from the ink supplying device to print a character on printing paper. Printers of this sort can make clear prints free of ink blurring.

However, since the ink droplets or globules which are ejected from the ink ejection head are extremely small in size and thus in heat capacity, they immediately lose their heat and solidify as soon as they are deposited on printing paper, forming a ridged lump of ink on the surface of the printing paper. Such an ink lump is apt to be scraped off or peeled from the printing paper when rubbed against other printing paper or scratched by an operator's hand. This makes printed characters unclear, and additionally creates a problem of smudging the back sides of overlying printed paper sheets when a number of printed paper sheets are piled one on another.

A technology for solving these problems is disclosed in Japanese Patent Application laid open No. 62-161542, which concerns a hot melt type ink jet printer which is provided with a pressing roller for applying pressure to a printed paper sheet. A printed portion of printing paper is gripped and pressed between the pressing roller and a paper-supporting platen both of which are formed of rigid material such as stainless steel, thereby flattening the ridged ink lump to some extent. A similar technology is also disclosed in U.S. Pat. No. 4,745,420.

The stainless steel pressing roller as employed in the ink jet printer of the above-mentioned Japanese patent publication, however, has a problem that the ink easily adheres to the pressure roller surface due to high cohesiveness of the metallic surface. It follows that the ink lump readily adheres to the pressing roller when pressed by the latter, as a result thinning the density of the printed character and contaminating the pressure roller surface which results in smudging of printing paper by transfer of the ink from the contaminated surface when the roller is later brought into contact with a newly printed paper surface.

Additionally, as long as the pressing roller is formed of a rigid material, including metal or non-metallic materials, there is a problem that the ink lumps are cracked in peripheral portions as they are crushed by the pressure roller and caused to rise up from the printing paper increasing the possibility of peeling due to lowered adhesion.

SUMMARY OF THE INVENTION

It is therefore an object of the present invention to provide a hot melt type ink jet apparatus which is capable of pressing ink lumps substantially free of adhesion of ink to a pressing member.

It is another object of the present invention to provide a hot melt type ink jet apparatus which is capable of pressing ink lumps without impairing adhesion of ink lumps to printing paper.

In accordance with the present invention, there is provided a hot melt ink jet apparatus for heating a normally solid ink into a molten state and for ejecting the molten ink toward a recording sheet, the apparatus comprising: recording means for ejecting molten ink onto a first face of the recording sheet; supporting means for supporting the recorded recording sheet at a second face opposite to the first face; an intervention member having a low cohesive surface provided at a side facing the first face; and pressing means for pressing the recorded recording sheet against said supporting means through said intervention member.

BRIEF DESCRIPTION OF THE DRAWINGS

The above and other objects, features and advantages of the invention will become apparent from the following description of preferred embodiments, taken in conjunction with the accompanying drawings in which.

DETAILED DESCRIPTION OF THE PREFERRED EMBODIMENTS

Figure 1:
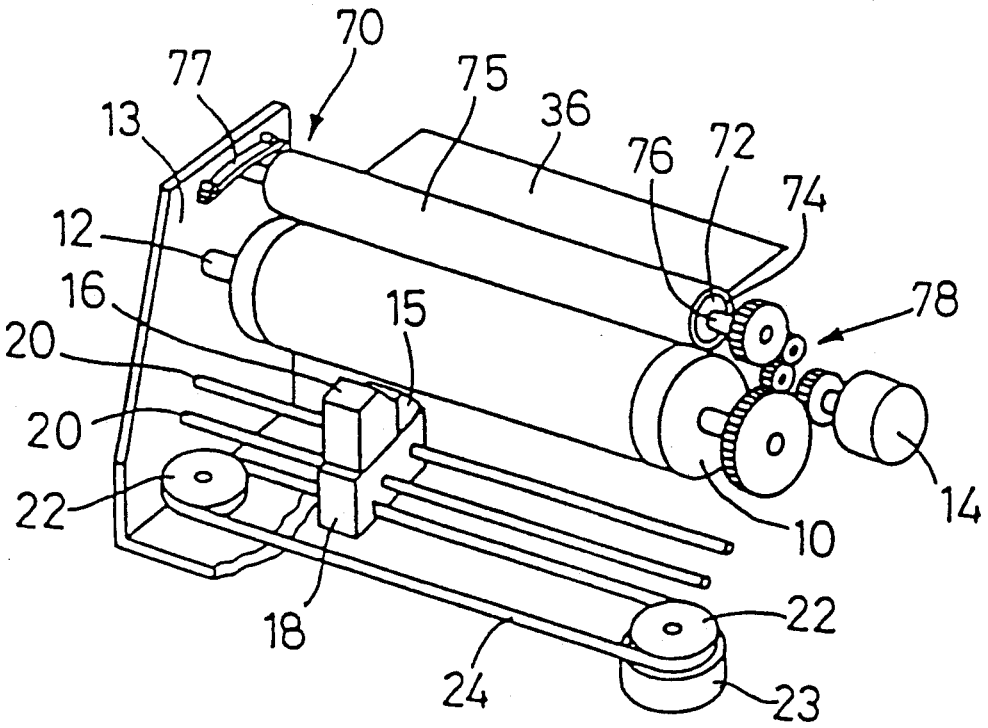
FIG. 1 is a perspective view of major components of a hot melt type ink jet printer embodying the present invention.

Illustrated in FIG. 1 are major components of a hot melt type ink jet printer embodying the present invention, including a hollow cylindrical platen 10 of, for example, stainless steel which is rotatably mounted on a frame 13 through a shaft 12 and rotationally driven from a motor 14. An ink ejector head 15 is located in face to face relation with the platen 10. The ink ejector head 15 is mounted on a carriage 18 together with an ink supplying device 16. The carriage 18 is slidably supported on a pair of guide rods 20 which are provided parallel with the axis of the platen 10, and connected to a timing belt 24 which is passed around a pair of pulleys 22. One of the pulleys 22 is rotated by a motor 23 to feed the timing belt 24, moving the carriage 18 transversely along the platen 10.

Figure 3:
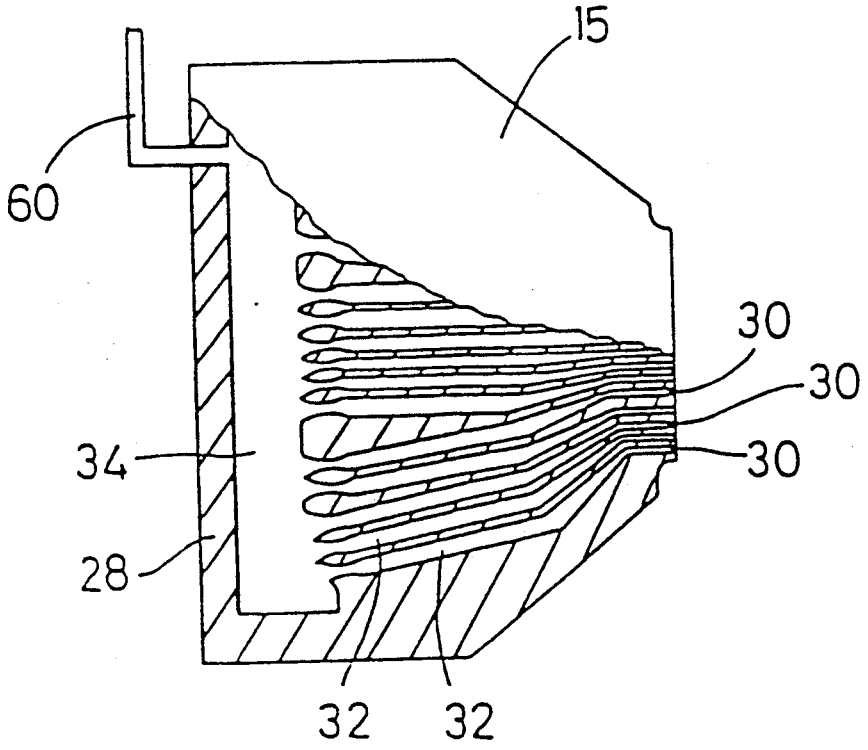
FIG. 3 is a partly cutaway side view of an ink ejector head of the printer.

As shown particularly in FIG. 3, the ink ejector head 15 is provided with a row of a plurality of ejection holes 30 vertically arranged within a casing 28. These ejection holes 30 are in communication with an ink reservoir 34 in a rear portion of the head through ink chambers 32 which are formed within the casing 28. A strip-like oscillatory member (not shown) is provided in each ink chamber 32 on one side thereof in the direction of movement of the head, such that the ink in the ink chamber 32 is ejected through the ejection hole 30 by a pressure variation resulting from electric deformation of the oscillatory member. By this ink ejection, a figure is printed on a printing paper sheet 36 which is supplied between the platen 10 and ink ejector head 15.

Figure 4:
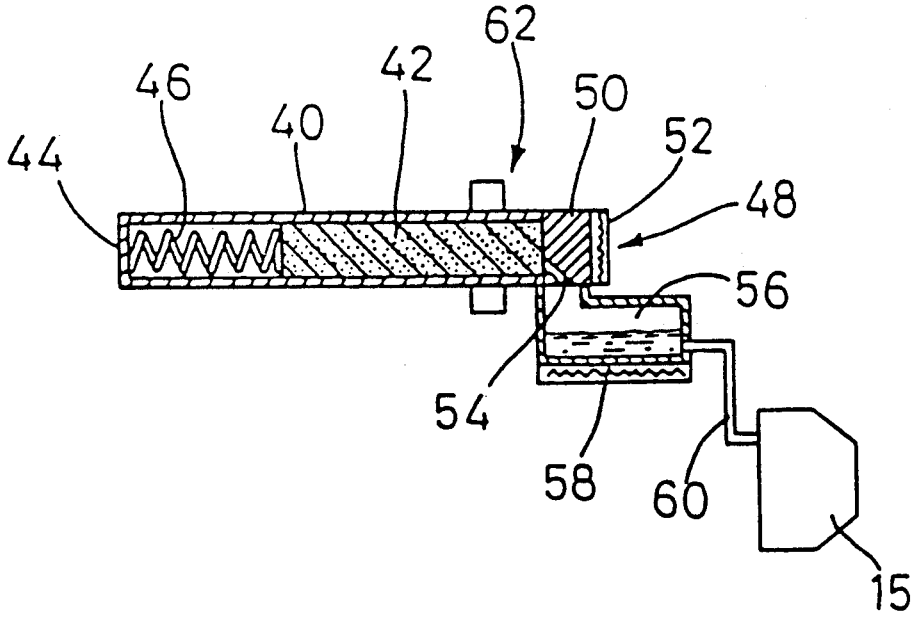
FIG. 4 is a sectioned side view of an ink supplying device.

As seen in FIG. 4, the ink supplying device 16 is provided with a bottomed cylindrical ink case 40 in which a normally solid ink block 42 is axially slidably fitted. The ink block 42 is urged toward the open end of the ink case 40 by a compression spring 46 which is interposed between the bottom wall 44 of the ink case 40 and the ink block 42. An ink heater 48 is attached to the open end of the ink case 40. The ink heater 48 includes a heating plate 50 which is in contact with the forward end of the ink block, and a heat generating resistor 52 which heats up the heating plate 50. The ink block portion which is in contact with the heating plate 50 is melted by the heat from the heating plate 50 and pooled in an ink sink 56 through a passage 54. The ink in the ink sink 56 is kept in a molten state by a resistance heating plate 58, and led to the ink reservoir 34 in the ink ejection head 15 through a conduit 60. In this instance, the ink sink 56 is provided with a sensor (not shown) which serves to measure the amount of the molten ink in the sink 56, and cooperates with the ink heater in such a manner as to maintain a constant amount of ink in the sink 56 by heating and melting only a necessary amount of the ink block 42 without unnecessary heating thereof. Indicated at 62 is an ink block sensor which detects a shortage of ink block 42 in the ink case.

Figure 2:
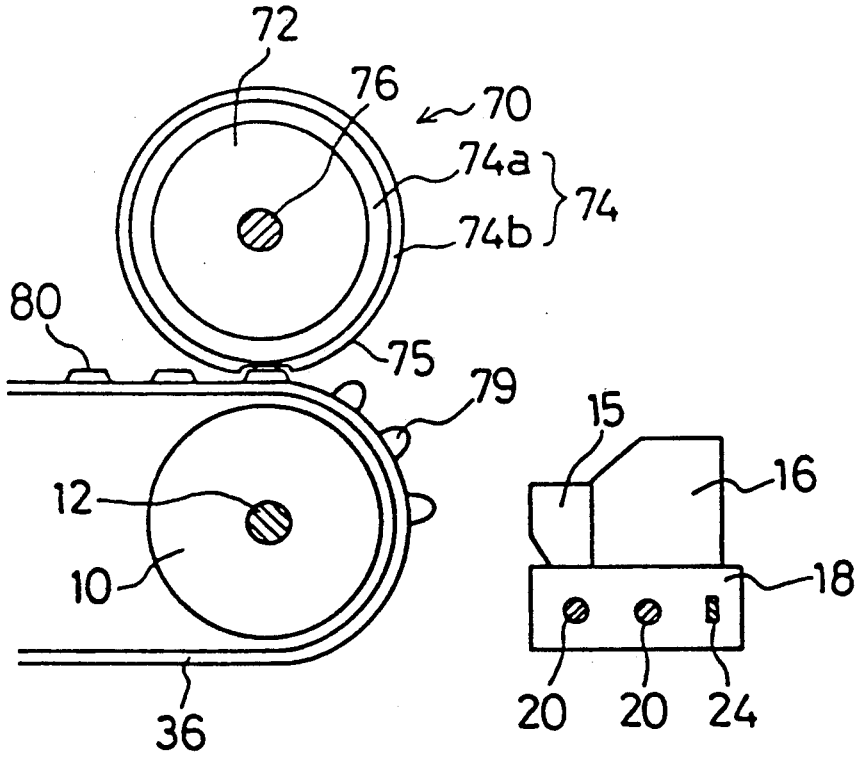
FIG. 2 is a side view of the printer.

In FIGS. 1 and 2, a pressing roller 70 which serves as a pressing member is located above the platen 10. The pressing roller 70 includes a base member which is constituted by a hollow cylinder of a metal such as stainless steel or the like. The base member 72 has substantially the same length as the platen 10 and bears a synthetic resin layer 74 on the surface thereof. The synthetic resin layer 74 has a double-layer structure composed of an inner synthetic resin layer **74*a* of polyethylene terephthalate which is harder than the lumps of ink in solidified state, and an outer synthetic resin layer 74*b* of polyethylene which is soft as compared to the ink in solidified state and also has low cohesiveness to the ink. Namely, the hard synthetic resin layer 74*a* is coated on the surface of the base member 72, and then the soft synthetic resin layer 74*b* is coated on the hard synthetic resin layer 74*a*. Accordingly, the surface of the pressing roller 70, more specifically, the roller surface 75 which contacts the printed portion of the printing paper 36 is covered with the synthetic resin layer 74*b* having a low cohesiveness. The pressing roller 70 is mounted on the frame 13 through a shaft 76 for rotation about an axis parallel with the axis of the platen 10, and is urged into abutting contact with the platen 10 by a pair of left and right springs 77 (only one of which is shown). Rotation of a motor 14 is transmitted to the shaft 76 through a gear train 78 to rotate the pressing roller 70 at the same circumferential speed as the platen 10. The supplied printing paper 36 is printed at a position between the platen 10 and ink ejection head 15, and the printed portion of the printing paper 36 is then fed to a position between the platen 10 and pressing roller 70 and pressed by the roller 70 while being supported by the platen 10. That is to say, the platen 10 also serves as a support member for the printing paper 36** while the latter is pressed.

With an ink jet printer arranged in the above-described manner, the printing paper 36 which has been printed by the ink ejector head 15 is fed to a position between the platen 10 and pressing roller 70. The droplets which are ejected from the ink ejection head 15 are in the form of spherical globules having a diameter of about 30 μm, and, due to their small heat capacity, solidify as soon as they are deposited on the surface of the printing paper 36, forming semi-spherical ink lumps 79 as shown in a somewhat emphasized manner in FIG. 2. While passing through a path between the platen 10 and pressing roller 70, these ink lumps 79 are pressed by the pressing roller 70 to form flattened ink lumps 80. In this embodiment, the outer synthetic resin layer **74*b* having a low cohesiveness which contacts the ink lumps 79 is coated in a small thickness of about 10 μm as compared with the height of the ink lumps 79 (about 20 μm) from the surface of the printing paper 36**.

In a case where the ink lumps 79 are directly pressed by a metallic pressing roller as in the previously mentioned hot melt printers, it is very likely that the ink will adhere to the surface of the pressing roller, thinning the density of the print or smudging the printing paper face in the next pressing operation. However, in the above-described embodiment of the invention, the ink lumps 79 are pressed through the less cohesive synthetic resin layer **74*b* to preclude adhesion of the ink to the contacting surface 75 of the pressing roller 70. Further, in the case of direct pressing by a metal roller, the ink lumps 79 undergo forced deformation as they are forcibly pressed into a substantially uniform thickness between the roller 70 and platen 10. As a result, cracks occur in the peripheral portions of the ink lumps 79, increasing the possibility of peeling of the ink lumps 79 from the printing paper 36. In contrast, in the present embodiment of the invention incorporating the outer synthetic resin layer 74*b* which is low in cohesiveness and softer than the ink lumps 79, the ink lumps 79 are pressed through the outer synthetic resin layer 74*b*, so that the force which is applied to the ink lumps 79 is appropriately dispersed and thus moderates the deformation of the ink lumps 79 which otherwise would lead to cracks in their peripheral portions. Consequently, the ink lumps 79 become less susceptible to peeling from the printing paper 36. Further, when the soft and less cohesive outer synthetic resin layer 74*b* is formed having a thickness equivalent to or slightly less than that of the ink lumps 79 as in the present embodiment of the invention, it is possible to preclude the problem of insufficient pressure application to the ink lumps 79 because the amount of deformation of the outer synthetic resin layer 74*b* is restricted by the underlying hard inner synthetic resin layer 74*a* even if the outer synthetic resin layer 74*b* is appreciably softer than the ink lumps 79**.

Moreover, from the standpoint of the material, it is possible to integrally join the less cohesive outer synthetic resin layer **74*b* with the hard inner synthetic resin layer 74*a*. When the two layers are joined together, the less cohesive outer synthetic resin layer 74*b* is reinforced by the hard inner synthetic resin layer 74*a*** and imparted with higher durability by the latter.

Figure 5:
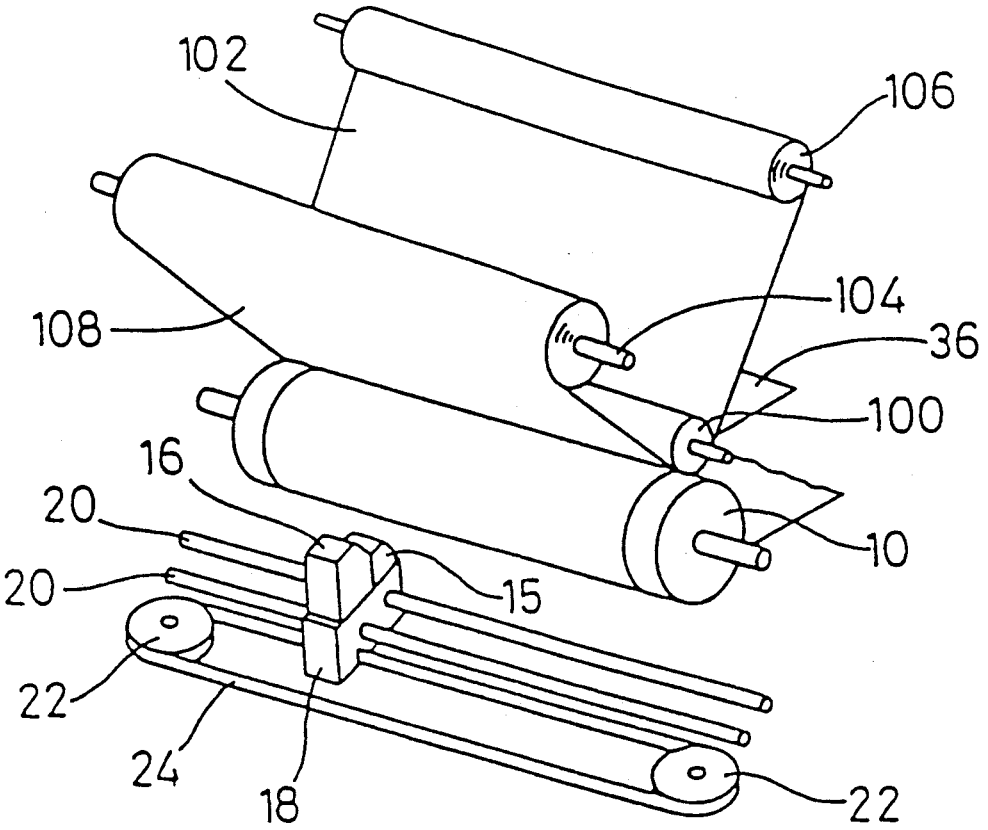
FIG. 5 is a perspective view of major components of a hot melt type ink jet printer in another embodiment of the invention.
Figure 6:
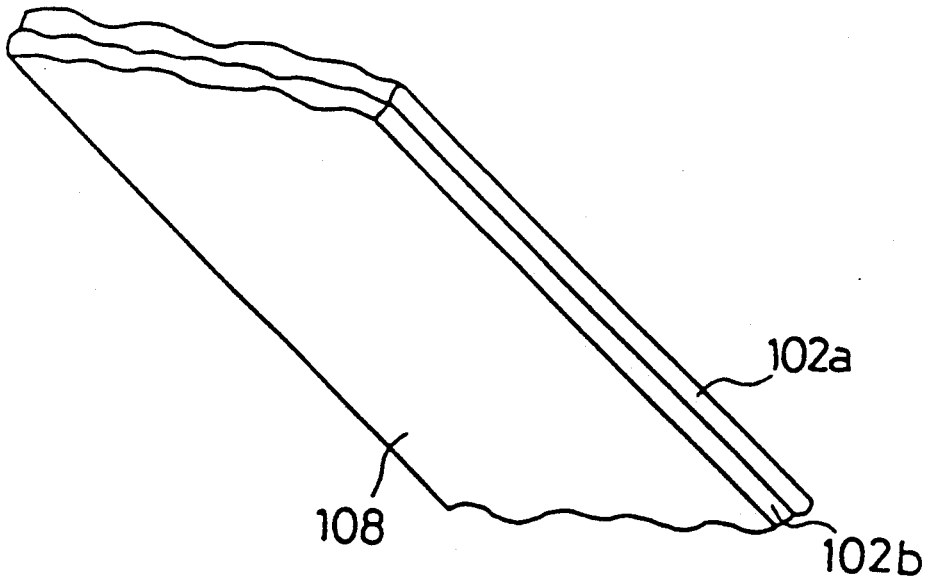
FIG. 6 is a perspective view of a synthetic resin film structure according to the invention.

Shown in FIG. 5 is another embodiment of the invention, in which a synthetic resin film 102 is interposed between the platen 10 and a pressing roller 100. The synthetic resin film 102 is composed of a hard synthetic resin layer **102*a* of polyethylene terephthalate and a less cohesive synthetic resin layer 102*b* of polyethylene (as shown in FIG. 6). The pressing roller 100 is in the form of a hollow cylinder constructed of a metal such as stainless steel or the like. The synthetic resin film 102 is wound into a roll form on a feeder roller 104, and fed to a take-up roller 106 through a path between the platen 10 and pressing roller 100. The synthetic resin film 102 has the less cohesive synthetic resin layer 102*b* on the side of the platen 10. Namely, the surface on the lower side of the film 102, that is to say, the contacting surface 108 which contacts a printed portion of the printing paper 36 is covered with the less cohesive synthetic resin layer 102*b*. The synthetic resin layer 102*b* is formed in a thickness which is sufficient for ensuring resiliency of the contacting surface 108. In this embodiment, the pressing member is constituted by the pressing roller 100 and the synthetic resin film 102. The take-up roller 106 is rotationally driven from a platen drive motor through a friction transmission mechanism (not shown) which is adapted to absorb excessive rotations by slipping motions to take up the film at a uniform rate with the printing paper 36 which is fed by the platen 10 and pressing roller 100**.

According to this embodiment, there is no need for replacing the pressing roller even if the ink is transferred to the resin film as a result of the pressing operation, it suffices to replace the resin film alone. This advantageously suppresses increases in cost.

The above-described resin film may be of an endless form, which is arranged to circulate along an endless path. Although the platen 10 is adopted to function also as a support member for the pressing operation in the foregoing embodiments, there may be provided a support member separately from the platen 10 if desired. The pressing member may not necessarily be in the form of a roller, and may be of a block or other suitable form which is movable toward and away from the support member.

The invention has been described particularly by way of preferred embodiments, but it is to be understood that it is possible for those skilled in the art to add various alterations or modifications thereto in practicing the present invention.

What is claimed is:

1. A hot melt ink jet apparatus for heating a normally solid ink into a molten state and for ejecting the molten ink toward a printing sheet, the apparatus comprising:

printing means for printing by ejecting molten ink onto a first face of the printing sheet;

supporting means for supporting the printed printing sheet at a second face opposite to the first face;

an intervention member including a deformable layer having a low cohesive surface provided at a side of said supporting means and facing the first face, said deformable layer being softer than lumps of solidified ink on the printing sheet so that said deformable layer is deformed when pressed against the lumps; and pressing means for pressing said printed printing sheet against said supporting means through said intervention member, wherein said deformable layer has a thickness which is thinner than a height of the ink lumps, and is attached to a surface which is harder than said ink lumps.

2. The hot melt ink jet apparatus according to claim 1, wherein said intervention member is provided on said pressing means.

3. The hot melt ink jet apparatus according to claim 1, wherein said low cohesive surface has a cohesiveness with the ink which is lower than the cohesiveness of a pressing surface of said pressing means with the ink.

4. The hot melt ink jet apparatus according to claim 1, wherein said supporting means is a platen roller, and wherein said pressing means is a cylindrical roller.

5. A hot melt ink jet apparatus for heating a normally solid ink into a molten state and for ejecting the molten ink toward a printing sheet, the apparatus comprising:

printing means for printing by ejecting molten ink onto a first face of the printing sheet;

supporting means for supporting the printed printing sheet at a second face opposite to the first face;

an intervention member having a deformable layer provided at a side of said supporting means and facing the first face, wherein said deformable layer is softer than lumps of solidified ink on the printing sheet so that said deformable layer is deformed when pressed against the lumps, said deformable layer having a thickness which is thinner than a height of the ink lumps, and being attached to a surface which is harder than said ink lumps; and pressing means for pressing the printed printing sheet against said supporting means through said intervention member.

6. The hot melt ink jet apparatus according to claim 5, wherein a pressing surface of said pressing means is harder than the lumps of solidified ink.

7. The hot melt ink jet apparatus according to claim 5, wherein said intervention member is a film provided between said supporting means and said pressing means.

8. The hot melt ink jet apparatus according to claim 5, wherein said intervention member includes a backing layer attached to and provided behind said deformable layer which is harder than the lumps of solidified ink on the printing sheet.

9. The hot melt ink jet apparatus comprising:

printing means for printing on a recording medium by ejecting molten ink onto a first face of the recording medium;

supporting means for supporting the recording medium after being printed on by said printing means, said supporting means supporting the recording medium at a second face of the recording medium, the second face being opposite to the first face;

a cylindrical metal roller for pressing the recording medium against said supporting means so that lumps of ink on the recording medium are flattened; and an intervention member located between said metal roller and said supporting means and contacting said metal roller so that said metal roller is prevented from directly contacting the recording medium, said intervention member having a deformable layer provided at a side of said supporting means and facing said first face, wherein said deformable layer is softer than lumps of solidified ink on the printing sheet so that said deformable layer is deformed when pressed against the lumps, said deformable layer having a thickness which is thinner than a height of the ink lumps, and being attached to a surface which is harder than said ink lumps.

10. The hot melt ink jet apparatus according to claim 9, wherein said intervention member is a film of material.

11. The hot melt ink jet apparatus according to claim 10, wherein said film entirely encircles an outer peripheral surface of said cylindrical roller.

12. The hot melt ink jet apparatus according to claim 10, further comprising a feeder reel and a take-up reel, said film extending between said feeder reel and take-up reel.

13. The hot melt ink jet apparatus according to claim 9, wherein said intervention member is made from a material having a low cohesive surface.

14. The hot melt ink jet apparatus according to claim 13, wherein said material is polyethylene.

15. The hot melt ink jet apparatus according to claim 9, wherein said deformable layer is made from polyethylene and said intervention member further comprises a backing layer attached to said deformable layer and located adjacent to said pressing means, said backing layer being harder than the lumps of solidified ink on the recording medium.

16. The hot melt ink jet apparatus according to claim 15, wherein said backing layer is made from polyethylene terephthalate.

17. The hot melt ink jet apparatus according to claim 1, wherein said low cohesive surface is solid when pressed by said pressing means.

18. The hot melt ink jet apparatus according to claim 13, wherein said material having the low cohesive surface is solid when pressed by said pressing means.

* * * * *